US005733695A

United States Patent [19]

Molaire et al.

[11] Patent Number: 5,733,695

[45] Date of Patent: Mar. 31, 1998

[54] ELECTROPHOTOGRAPHIC ELEMENTS WITH GENERATING LAYERS CONTAINING POLYESTER IONOMERS

[75] Inventors: Michel F. Molaire; Louis Joseph Sorriero, both of Rochester, N.Y.

[73] Assignee: Eastman Kodak Company, Rochester, N.Y.

[21] Appl. No.: 562,668

[22] Filed: Nov. 27, 1995

[51] Int. Cl.[6] ..... G03G 5/05

[52] U.S. Cl. ..... 430/58; 430/64; 430/96

[58] Field of Search ..... 430/96, 32, 73, 430/64, 58

[56] References Cited

U.S. PATENT DOCUMENTS

| | | | |
|---|---|---|---|
| 4,361,636 | 11/1982 | Isaacson et al. | 430/32 |
| 4,419,437 | 12/1983 | Noonan et al. | 430/270 |
| 4,463,078 | 7/1984 | Noonan et al. | 430/73 |
| 5,102,731 | 4/1992 | Takimoto et al. | 428/323 |
| 5,380,584 | 1/1995 | Anderson et al. | 428/323 |

OTHER PUBLICATIONS

Docket 65396, now U.S. Provisional Application No. 60/003,092, filed Mar. 31, 1995 by Douglas E. Bugner.

*Primary Examiner*—John Goodrow
*Attorney, Agent, or Firm*—John R. Everett

[57] ABSTRACT

A multiactive electrophotographic element comprising an electrically conductive support, a photoconductive pigment containing charge generation layer and a charge transport layer wherein the charge generation layer contains a polyester-ionomer binder having a weight average molecular weight of 2,500 to 75,000 and a glass transition temperature of 20° to 150° C.

10 Claims, No Drawings

ELECTROPHOTOGRAPHIC ELEMENTS WITH GENERATING LAYERS CONTAINING POLYESTER IONOMERS

FIELD OF THE INVENTION

This invention relates to electrophotography.

BACKGROUND OF THE INVENTION

Multiactive electrophotographic elements are known. They are useful in electrophotographic copiers and printers. One type comprises, in the following order, a conducting support, a barrier layer, a charge generating layer (CGL) and a charge transport layer (CTL). To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves in nonirradiated areas a charge pattern known as a latent electrostatic image. The latent image can be developed, either on the surface on which it is formed or on another surface to which it is transferred, by application of a liquid or dry developer containing finely divided charged toner particles.

One type of charge-generating layer photogenerate holes and injects the generated holes into the charge-transport layer. With many charge generating layers, especially those containing photoconductive pigments, dark decay is a problem. Holes are injected from the conductive layer into the charge-generating layer in the dark, thereby adversely affecting the charge acceptance of the element. When such injection occurs, surface charges on the photoconductive element are dissipated in non-exposed areas of the surface, i.e., in dark areas not exposed to actinic radiation. Consequently, when charged toner contacts the photoconductive surface, it causes unwanted development in background areas. The prior art solves this problem by inserting hole blocking barrier layers between the conductive layer and the charge-generating layer.

Multiactive electrophotographic elements tend to delaminate because of poor interlayer adhesion. The prior art attacks this problem by inserting adhesive layers either between the barrier layer and the charge-generating layer, or between the charge- generating layer and the charge-transport layer. The particle size of pigment particles in the pre-coated dispersion for charge generating layers is very important to obtain a charge generation layer with good uniformity. However many times, the binders with optimum dispersive quality tend to create adhesion problem, necessitating extra adhesive layers.

SUMMARY OF THE INVENTION

The present invention provides a multiactive electrophotographic element comprising an electrically conductive support, a photoconductive pigment containing charge generation layer and a charge transport layer wherein the charge generation layer contains a polyester-ionomer binder having a weight average molecular weight of 2,500 to 75,000, preferably 10,000 to 45,000, and a glass transition temperature of 20° to 150° C., preferably 25° to 85° C.

The above charge generation layers are useful in multiactive electrophotographic elements comprising an electrically conductive support, a photoconductive pigment containing charge generation layer and a charge transport layer wherein the charge generation layer (A) is in direct physical contact with the conductive support and (B)contains a polyester-ionomer binder having a molecular weight of 2,500 to 75,000 and a glass transition temperature of 20° to 150° C.

We have found that in the described multiactive electrophotographic elements the above described polyester-ionomers:

- are unexpectedly good binders for dispersing pigments used in charge-generation layers;
- block hole injection from the underlying conductive layer thereby eliminating the need for a hole blocking barrier layer; and
- impart good adhesion of the charge generating layer to both the charge transport layer, and the conductive layer thereby eliminating the need for additional adhesive layers.

The invention further provides a multiactive electrophotographic element comprising, in the following order, a conductive support, a barrier layer, a photoconductive pigment containing charge generation layer and a charge transport layer wherein the charge generation layer contains a polyester-ionomer binder having a molecular weight of 2,500 to 75,000 and a glass transition temperature of 20° to 150° C.

The barrier layer, in this alternative, can be used for enhanced hole blocking efficiency in very high quality applications, or as a solvent barrier for certain conductive layers such as the transparent conductors described in Trevoy U.S. Pat. No. 3,428,451, or Perez-Albuerne, U.S. Pat. No. 3,932,179, or Steklensky et al. U.S. Pat. No. 4,082,551, or Scozzafava et al, U.S. Pat. No. 4,485,161.

DETAILS OF THE INVENTION

These polyesters are prepared by reacting one or more dicarboxylic acids or their functional equivalents such as anhydrides, diesters, or diacid with one or more diols in melt phase polycondensation techniques. Procedures for the preparation of polyester-ionomers are described in U.S. Pat. Nos. 3,018,272; 3,563,942; 3,734,874; 3,779,993; 3,929,489; 4,307,174.

Polyester-ionomer concentration in the charge generation layer is 10 to 90 weight percent, preferably 30 to 70 weight percent of the charge generation layer.

Useful polyester-ionomers can be selected from those having a structure according to formula I.

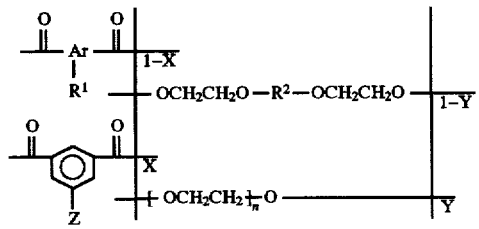

(I)

wherein $R^1$ represents alkyl groups such as methyl, and t-butyl;

$R^2$ represents cyclohexyl, 1,4-dimethylenecyclohexane, 4,4'-benzophenone, 4,4'-diphenylmethane, diphenylsulfone, 4,4'-isopropylidene bisphenylene, 4,4'-hexafluoroisopropylidene bisphenylene, 4,4'-cyclohexylidene bisphenylene, 4,4'-norbornylidene bispheylene, 4,4'-indnylidene bisphenylene, and 4,4'-fluorenylidene bisphenylene Ar represents an aromatic group that contains an asymetric center such as isophthalic acid 1,1,3-trimethyl-3-(4-carboxyphenyl)-5-5-indancarboxylate, and 3-methyl phthalic anhydride, methylsuccinic acid, and 2-ethyl-1,6-hexanedioic acid;

Z represents

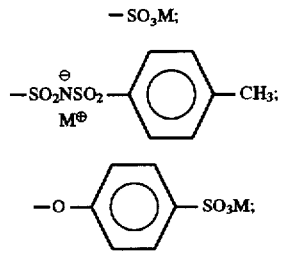

M represents an alkali earth metals such as lithium, sodium, or potassium; ammonium, trimethylammonium, triethylammonium, and hydroxylalkylammonium such as dihydroxyethylammonium, and trihydroxyethylammonium; and n is an integer of from 2 to 12;

X represents from 1 to 30 mole percent; and

Y represents from 0 to 100 mole percent.

Useful polyester-ionomers according to structure I can be prepared by means of melt phase polycondensation techniques (Sorenson and Campbell, "Preparative Methods of Polymer Chemistry", 2nd. Ed., p. 132, Interscience Publishers, 1968), well known to those skilled in the art. The examples sited are representative of some, but certainly not all of the variations which were evaluated. Those skilled in the art will recognize that the procedure is not limited to the use of diesters and diols, that these polymers could also be prepared from the diacids, and the bisacetates accompanied by the appropriate catalyst. The examples serve to illustrate the utility of the present invention and are prepared as follows:

Control Polymer: poly[1,4-cyclohexylenedimethylene-co-2,2'-oxydiethylene (46/54) isophthlate]; 38.8 grams ( 0.200 moles) of dimethylisophthlate, 13.25 grams (0.092 moles) of cyclohexane dimethanol, 16.03 grams (0.151 moles) of 2,2'-oxydiethanol, and 100 ppm Titanium catalyst was combined in a polymerization flask equipped with a nitrogen bubbler, Claisen head, and thermometer. The contents were placed in a salt bath at 200° C. to achieve a homogenous melt and interchanged over a temperature range from 200° C. to 240° C. for a period of 3 hours. The flask was the equipped with a stirred, connected to a vacuum source, and the polycondensation step was performed at 240° C. until the desired melt viscosity as monitored by stirrer torque was achieved. The resulting polyester had a glass transition temperature (Tg) of 32° C., an inherent viscosity(IV) in dichloromethane(DCM) of 0.28 dl/g, and a weight average molecular weight of 12,000.

Polymer A: poly[1,4-cyclohexylenedimethylene-co-2,2'-oxydiethylene (46/54) isophthlate -co-5-sodiosulfoisophthlate (95/5)]; Polymer variant A was prepared as per the control polymer except that 1.92 grams of dimethylisophthlate was replaced with 2.96 grams (0.010 moles) of dimethyl-5-sodiosulfoisophthlate. The resulting polyester-ionomer had a Tg of 34° C., IV/DCM of 0.27 dl/g, and a weight average molecular weight of 24,600.

Polymer B: poly[1,4-cyclohexylenedimethylene-co-2,2'-oxydiethylene (46/54) isophthlate-co-5-sodiosulfoisophthlate (90/10)]; Polymer variant B was prepared in the same manner as the control polymer except that 3.9 grams of dimethyl isophthalate was replaced with 5.92 grams (0.020 moles) of dimethyl-5-sodiosulfoisophthalate. The resulting polyester-ionomer had a Tg of 34° C., IV/DCM of 0.18 dl/g, and a weight average molecular weight of 12,000.

Polymer C: poly[1,4-cyclohexylenedimethylene-co-2,2'-oxydiethylene (46/54) isophthalate-co-5-sodiosulfoisophthalate (85/15)]; Polymer variant C was prepared in the same manner as control the polymer except that 5.8 grams of dimethylisophthalate was replaced with 8.88 grams (0.030 moles) of dimethyl-5-sodiosulfoisophthalate. The resulting polyester-ionomer had a Tg of 42° C., an IV/DCM of 0.13 dl/g., an a weight average molecular weight of 24,000.

Polymer D: poly[1,4-cyclohexylenedimethylene-co-2,2'-oxydiethylene (46/54) isophthalate-co-5-sodiosulfoisophthalate (80/20)]; Polymer variant D was prepared in the same manner as the control polymer except that 7.76 grams of dimethylisophthalate was replaced with 11.84 grams (0.040 moles) of dimethyl-5-sodiosulfoisophjthalate. The resulting polyester-ionomer had a Tg of 48° C., an IV/DCM of 0.10 dl/g, and a weight average molecular weight of 29,000.

Polymer E: poly[1,4-cyclohexylenedimethylene-co-2,2'-oxydiethylene (46/54) isophthalate-co-5-sodiosulfoisophthalate (75/25)]; Polymer variant E was prepared in the same manner as the control polymer except that 9.7 grams of dimethylisophthalate was replaced with 14.8 grams (0.050 moles) of dimethyl-5-sodiosulfoisophthalate. The resulting polyester-ionomer had a Tg of 50° C., an IV/DCM of 0.085 dl/g, and a weight average molecular weight of 15,000.

Polymer F: poly[1,4-cyclohexylenedimethylene-co-2,2'-oxydiethylene (46/54) isophthalate-co-5-lithiosulfoisophthalate (90/10)]; Polymer variant F was prepared in the same manner as the control polymer except that 3.88 grams of dimethyl-5-sodiosulfoisophthalate was replaced with 2.52 grams(0.010 moles) of dimethyl-5-lithiosulfoisophthalate. The resulting polyester-ionomer had a Tg of 34° C., an IV/DCM of 0.20 dl/g, and a weight average molecular weight of 16,800.

Polymer G: poly[1,4-cyclohexylenedimethylene-co-2,2'-oxydiethylene (46/54) isophthalate-co-triphenylmethylphosphoniumsulfoisophthalate (90/10)]; Polymer variant G was prepared in the same manner as the control polymer except that 3.88 grams of dimethyl-5-sodiosulfoisophthalte was replaced with 5.5 grams (0.010 moles) of dimethyl-5-triphenylmethylphospohonium sulfoisophthalate. The resulting polyester-ionomer has a Tg of 38° C., an IV/DCM of 0.25 dl/g, and a weight average molecular weight of 12,600.

Polymer H: poly{1,4-cyclohexylenedimethylene-co-2,2'-oxydiethylene (46/54) isophthalate-co-5-(4-sulfophenoxy) isophthlate (90/10)}; Polymer H was prepared in the same manner as the control polymer except that 3.88 grams of dimethyl-5-sodiosulfoisophthalte was replaced with 3.87 grams (0.01 moles) of dimethyl-5-(sulfophenoxy) isophthalate. The resulting polyester-ionomer has a Tg of 42° C., an IV/DMF of 0.30 dl/g, and a weight average molecular weight of 27,500.

Polymer I: poly{1,4'-cyclohexyloxydiethylene terephthalate-co-5-(4-sulfophenoxy)isophthalate (70/30)}; Polymer G was prepared in the same manner as the control polymer except that 4,4'-hydroxyethoxycyclohexane was employed as the glycol component and a mixture of 13.58 grams (0.070 moles) dimethylterephthalate and 11.61 grams (0.030 moles) of dimethyl-5-sodiosulfophenoxy) isophthalate were employed as the acid components. The resulting polymer had a Tg of 72° C., an Iv/DMF of 0.32 dl/g, and a weight average molecular weight of 28,500.

Polymer J: poly[1,4-cyclohexylenedimethylene-co-2,2'-oxydiethylene (46/54) isophthalate-co-4,4'-dicarboxyphenylmethylphenyl phosphonium p-toluenesulfonate (90/10)]; Polymer J was prepared in the same manner as the control except that 1.94 grams (0.01 moles) of dimethylisophthalate was replaced with 5.40 grams (0.01 moles) of dimethylcarboxyphenylphenylmethyl phosphonium p-toluene sulfonate. The resulting polymer had a Tg of 48° C., an IV/DMF of 0.24 dl/g, and a weight average molecular weight of 22,500.

The layers of the multiactive electrophotographic elements can be made using well known solvent coating techniques. Such techniques are well known in this art. Indeed the methods are described in many published patents referred to herein. Several patents can be cited in the prior art, U.S. Pat. Nos. 3,245,833 and 3,428,451 to Trevoy, 3,932,179 to Perez-Albuerne, 4,082,551 to Steklenski et al., 4,410,614 to Lelental et al., and 4,485,161 to Scozzafava et al.

The charge-generation and charge-transport layers of the multiactive electrophotographic element are coated on an electrically-conductive support. In the alternative embodiment a barrier layer is coated between the charge generating layer and the conductive support Either the support material that is electrically-conductive or a non-conductive substrate coated with a conductive layer such as vacuum deposited nickel. The support can be fabricated in any suitable configuration, for example, as a sheet, a drum, or an endless belt.

Examples of electrically-conductive supports include paper (at a relative humidity above 20 percent); aluminum-paper laminates; metal foils such as aluminum foil, zinc foil, etc.; metal plates or drums, such as aluminum, copper, zinc, brass, and galvanized plates or drums; vapor deposited metal layers such as silver, chromium, nickel, aluminum, and the like coated on paper or on conventional photographic film bases such as cellulose acetate, poly(ethylene terephthalate), etc. Such conducting materials as chromium, nickel, etc., can be vacuum deposited on transparent film supports in sufficiently thin layers to allow electrophotographic elements prepared therewith to be exposed from either side of such elements. An especially useful conducting support can be prepared by coating a support material such as poly (ethylene terephthalate) with a conducting layer containing a semiconductor dispersed in a resin. Such conducting layers, both with and without electrical barrier layers, are described in Trevoy, U.S. Pat. No. 3,245,833, issued Apr. 12, 1966. Other useful conducting layers are disclosed in U.S. Pat. No. 3,880,657, U.S. Pat. No. 3,007,901, and U.S. Pat. No. 3,262,807.

As stated hereinbefore the polyester-ionomer containing charge generating layer can be applied directly to the conductive support thereby eliminating the need for a barrier layer to prevent hole injection from the conducting layer. Or the photoconducting charge generating layer can be coated over a barrier layer for enhanced barrier against hole injection. The layer can have a thickness which varies over a wide range, typical thicknesses being in the range of about 0.05 to about 6 μm. As those skilled in the art appreciate, as layer thickness increases, a greater proportion of incident radiation is absorbed by a layer, but the likelihood increases of trapping a charge carrier which then does not contribute to image formation. Thus, an optimum thickness of a given such layer can constitute a balance between these competing effects.

A wide variety of organic and inorganic photoconductive materials can be employed in the charge generation layer. Inorganic materials include, for example, zinc oxide, lead oxide and selenium. Organic materials include various particulate organic pigment materials and a wide variety of soluble organic compounds, including metallo-organic and polymeric organic photoconductors. A partial listing of representative photoconductive materials may be found, for example, in Research Disclosure, Vol. 109, May 1973, page 61, in an article entitled "Electrophotographic Elements, Materials and Processes", at paragraph IV(A) thereof, the disclosure of which is incorporated herein by reference. Perylene compounds described in U.S. Pat. No. 4,719,163 are useful. Particularly useful are phthalocyanines, titanlyphthalocyanines, titanylfluorophthalocyanines, hydroxygalliumphthalocyanines, co-crystals of titanylphthalocyanine and titanylfluorophthalocyanine, non-uniformly substituted phthalocyanine, chloroindiumphthalocyanines, bromoindiumphthalocyanines and naphthophthalocyanines.

Non-uniformly substituted phthalocyanine are made according to the procedure described in U.S. Ser. No. 08/448,056, filed May 23, 1995, entitled "NON-UNIFORMLY SUBSTITUTED PHTHALOCYANINE COMPOSITIONS, PREPARATION METHODS, AND ELECTROPHOTOGRAPHIC ELEMENTS", in the name of Molaire et al.

Other binders can be combined with the polyester-ionomers in the charge generation layer, especially embodiments of the invention that include a barrier layer. Such binders can be selected from various hydrophobic organic polymers such as poly(vinyl acetals), poly(vinyl butyral), polyesters, polycarbonates, polyacrylates or polymethacrylates, poly(vinylidene chloride), etc. These and other binders are well known in the art.

One or more hole donor agents can also be added in embodiments in which barrier layers are used. Such agents include 1,1-bis(4-di-p-tolylaminophenyl) cyclohexane, as taught in U.S. Pat. No. 4,127,412, incorporated herein by reference, tri-p-tolylamine, and the like. Coating aids, such as levelers, surfactants, crosslinking agents, colorants, plasticizers, and the like can also be added. The quantity of each of the respective additives present in a coating composition can vary, depending upon results desired and user preferences.

The charge transport layer can be comprised of any material, organic or inorganic, which is capable of transporting positive charge carriers generated in the charge generation layer. Most charge transport materials preferentially accept and transport either positive charges (holes) or negative charges (electrons), although there are materials known which will transport both positive and negative charges. Transport materials which exhibit a preference for conduction of positive charge carriers are referred to as p-type transport materials whereas those which exhibit a preference for the conduction of negative charges are referred to as n-type.

Various p-type organic charge transport materials can be used in the charge transport layer in accordance with the present invention. Any of a variety of organic photoconductive materials which are capable of transporting positive charge carriers may be employed. Many such materials are disclosed in the patent literature already cited herein. Representative p-type organic photoconductive materials include carbazole materials arylamines (3,3'-(4-p-tolylaminophenyl)-1-phenylpropane, 1,1-bis(4-di-p-tolylaminophenyl) cyclohexane, and tritolylamine); polyarylalkane materials.

The following examples illustrate the electrophotographic elements provided by the invention.

EXAMPLE 1

A multiactive electrophotographic element, comprising a 175 μm thick conductive support consisting of a thin layer of nickel on poly(ethylene terephthalate) substrate, a charge generation layer (CGL), and a charge transport layer (CTL), coated in that order, was prepared as follows:

A photoconductive pigment [co-crystal of 75 weight percent titanylphthalocyanine and 25 weight percent titanylfluorophthalocyanine (2.04 grams)] was mixed with a 1.02 g of poly [1 ,4-cyclohexylenedimethylene-co-2,2'-oxydiethylene (46/54) isophthalate-co-5-sodiosulfo-1,3-benzenedicarboxylate(82/18)], a polyester-ionomer sold under the trademark AQ55s by Eastman Chemical Company, 3 mm diameter stainless steel shots (58.5 grams), dichloromethane (58.5 grams) in a 6 ounce jar, and milled in a Sweco Vibro Energy grinding mill manufactured by Sweco, Inc. of Florence, Ky., for three days. The steel shot was then removed and rinsed with 18.83 grams of dichloromethane, and 39.57 grams of 1,1,2 trichloroethane, which was added back into the pigment dispersion.

The co-crystalline photoconductive pigment, titanylphthalocyanine and titanylfluorophthalocyanine, was prepared as follows: Crude titanyl phthalocyanine (7.5 g) and titanylfluorophthalocyanine (2.5 g) were mixed in a 16 ounce jar with 100 grams of 3 mm steel beads. The pigment mixture sample was then milled for three days using a Sweco Vibro Energy grinding mill manufactured by Sweco, Inc. The pigment particles were completely fused, coating the stainless steel beads, and agglomerating at the bottom of the jar in one big mass. The mass was broken down, and samples taken for X-ray diffraction analysis. The X-ray diffraction spectrum exhibited major peaks of the Bragg angle 2-theta at 7.2°, 15.4°, and 25.5° (all +/–0.2 ). To approximately 5 grams of the latter material, 200 grams of dichloromethane were added. The mixture was wet milled for 48 hours. Then the milling beads were separated, and the pigment mixture was filtered, washed with dichloromethane, and dried. The X-ray diffraction spectrum exhibited major peaks of the Bragg angle 2-theta at 7.4°, 10.1°, 12.6°, 13.1°, 14.9°, 15.9°, 17.2°, 18.5°, 22.4°, 24.3°, 25.5°, 26.9°, and 28.7° (all +/–0.2).

The resulting pigment dispersion was added to a solution of the AQ55s polyester-ionomer binder (1.53 grams), dichloromethane (grams), and 0.06 g of a siloxane surfactant sold under the trademark DC-510, by Dow Corning, USA. The resulting dispersion was filtered through an 8 micrometer filter and coated directly over the conductive film support using the hopper coating machine at a dry coverage of 0.05 g/ft$^2$ to form the CGL.

Coated directly over the CGL, at a dry coverage of 2.3 g/0.09 m$^2$ (2.3 g/ft$^2$), was a CTL solution comprising a polyester formed from 4,4'(2-norbornylidene) diphenol and a 40/60 molar ratio of terephthalic/azelaic acids (10 parts by weight), a polycarbonate sold by the Mobay Company under the trade name Makrolon (40 parts by weight), 1,1 -bis {4-(di-4-tolylamino)phenyl}cyclohexane (50 parts by weight), dissolved in dichloromethane (70 parts), and 1,1,2, trichloromethane (30 parts). DC510 was added at a concentration of 0.01 wt % of the total CTL mixture.

EXAMPLE 1A

A electrophotographic element was prepared in the same manner as described in example I except that a barrier layer of a polyamide resin, (2% weight solution) in ethanol solvent was coated at dry coverage of 0.05 g/0.091 m$^2$ (0.05 g/ft$^2$), between the conductive layer and the CGL of comparative example 1.

Comparative Example 1

A photoconductive element was prepared in the same manner as example 1, except that the polymeric binder in the CGL was polyvinyl butyral (PVB).

Comparative Example 1A

A photoconductive element was prepared in the same manner as described in comparative example 1 except that a barrier layer consisting of a polyamide resin, (2% weight solution) in ethanol solvent was coated at dry coverage of 0.05 g/0.091 m$^2$ (0.05 g/ft$^2$), between the conductive layer and the CGL of comparative example 1.

The resulting electrophotographic elements were then evaluated as follows. Red and near infrared photosensitivity was determined by electrostatically corona-charging the electrophotographic element to an initial potential of –700 volts and exposing the element to filtered light (narrow band pass) at a wavelength of 775 nm from a xenon flash lamp ( 160 microsecond flashes), in an amount sufficient to photoconductively discharge the initial potential down to a level of –350 volts (E50) and down to –150 volts (E80). Photosensitivity (also referred to as photographic speed) was measured in terms of the amount of incident actinic radiant energy (expressed in ergs/cm$^2$) needed to discharge the initial voltage down to the desired level of –350 volts. The lower the amount of radiation needed to achieve the desired degree of discharge, the higher is the photosensitivity of the element. Dark decay was determined by letting an unexposed area of the film spontaneously discharge in the dark for seven seconds. The dark decay was calculated by dividing the amount of dark discharge (after seven seconds) by seven. The results for example 1 and 1a, and comparative example 1 and 1a are shown in Table 1. It can be seen that the dark decay for the comparative example 1 is very high, and the addition of a barrier layer in comparative example 1a dramatically improves the dark decay. On the other hand example 1, in which a polyester-ionomer is used as a binder in the CGL and the CGL is coated directly on the conductive layer, shows very low dark decay. The addition of the barrier layer in example la, did not significantly affect the dark decay and electrophotographic speed of the element of example 1. Thus the inclusion of the polyester-ionomer in the CGL provided sufficient protection against hole injection from the conductive layer.

TABLE 1

| Examples or Comparative Examples | CGL Binder | Barrier Layer | E-50 ergs/cm$^2$ | E-80 ergs/cm$^2$ | Toe Volts | Dark Decay Volts/sec |
|---|---|---|---|---|---|---|
| Comparative Example 1 | PVB | none | NA | NA | NA | 28.6 |
| Comparative Example 1A | PVB | polyamide | 1.1 | 3.2 | 15 | 7.4 |

TABLE 1-continued

| Examples or Comparative Examples | CGL Binder | Barrier Layer | E-50 ergs/cm² | E-80 ergs/cm² | Toe Volts | Dark Decay Volts/sec |
|---|---|---|---|---|---|---|
| Example 1 | AQ55s | none | 2.4 | 7.1 | 60 | 2.9 |
| Example 1A | AQ55s | polyamide | 2.1 | 6.3 | 55 | 2.1 |

Adhesion Test

An adhesion test was run for each of the above examples as follows.

With a sharp razor blade, a line was cut across a 2×2 inch (25.4×25.4 mm) area in the middle of the CTL of each element. A piece of adhesive tape sold under the trademark Scotch by the US company 3M of Minneapolis, Minn. was firmly laminated to the area across the razor blade cut. Enough tape was left unlaminated so that the tape could be pulled away from the layer by hand while the element was restrained on a flat surface.

For the elements of Example 1 and 1a comprising the CGL containing the polyester-ionomer of this invention, the coating was left unaffected when the tape was removed from the surface of the CTL. On the other hand for the comparative examples 1 and 1a the CTL layer came off the CGL with the tape. This demonstrates improvement in adhesion imparted by inclusion of the polyester-ionomer in the CGL.

Examples 2–5 demonstrate the effect of ionomer mole concentrations on hole injection from the conductive layer.

EXAMPLES 2, 3, 4 & 5

Four electrophotographic elements were prepared in the same manner as example 1, except that the polymeric binder in the CGL was respectively polymer A: poly[1,4-cyclohexylenedimethylene-co-2,2'-oxydiethylene (46/54) isophthalate-co-5-sodiosufoisophthalate 95/5)](example 2); polymer B: poly[1,4-cyclohexylenedimethylene-co-2,2'-oxydiethylene (46/54) isophthalate-co-5-sodiosufoisophthalate 90/10)](example 3); polymer C: poly[1,4-cyclohexylenedimethylene-co-2,2'-oxydiethylene (46/54) isophthalate-co-5-sodiosufoisophthalate 85/15)](example 4); polymer E: poly[1,4-cyclohexylenedimethylene-co-2,2'-oxydiethylene (46/54) isophthalate-co-5-sodiosufoisophthalate 75/25)](example 5).

EXAMPLES 2A, 3A, 4A, & 5A

Four additional electrophotographic elements were prepared as in examples 2–5, except that a barrier layer consisting of a polyamide resin, (2% weight solution) in ethanol solvent was coated at dry coverage of 0.05 g/0.091 m² (0.05 g/ft²), between the conductive layer and the CGL of examples 2–5.

Comparative Example 2

A electrophotographic element was prepared as in example 1, except that the polymeric binder in the CGL was poly[1,4-cyclohexylenedimethylene-co-2,2'-oxydiethylene (46/54) isophthalate].

Comparative Example 2A

An electrophotographic element was prepared as in comparative example 2 except that the barrier layer was a polyamide resin, (2% weight solution in ethanol) coated at dry coverage of 0.05 g/0.091 m² (0.05 g/ft²), between the conductive layer and the CGL of comparative example 2.

The electrophotographic results for these examples are shown in Table 2. The effect of ionomer concentration can be seen on the E50 and E80 speeds, as well as the toe. With ionomer concentrations above 10 mole percent, the E50 and E80 speeds decrease, while the toe voltage increases. However dark decay is comparable for all the samples except for the comparative examples where the dark decay is two to three times higher.

TABLE 2

| Examples or Comparative Examples | CGL Binder | Ionomer Concentration (mole %) | Barrier Layer | E-50 ergs/cm² | E-80 ergs/cm² | Toe Volts | Dark Decay Volts/sec | Particle Size |
|---|---|---|---|---|---|---|---|---|
| Comparative Example 1 | PVB | | none | | | | | 0.34 |
| Comparative Example 2 | Control | 0 | none | 2.5 | 7.6 | 49 | 10 | 0.27 |
| Comparative Example 2A | Control | 0 | Polyamide | 1.2 | 5.6 | 50 | 11.4 | |
| Example 2 | Polymer A | 5 | none | 1.3 | 4 | 55 | 4.3 | 0.28 |
| Example 2A | Polymer A | 5 | Polyamide | 1.4 | 3.7 | 40 | 5.7 | |
| Example 3 | Polymer B | 10 | none | 1.5 | 5.1 | 70 | 2.9 | 0.31 |
| Example 3A | Polymer B | 10 | Polyamide | 1.1 | 3.4 | 55 | 3.6 | |
| Example 4 | Polymer C | 15 | none | 2.5 | 7.9 | 60 | 4.3 | 0.28 |
| Example 4A | Polymer C | 15 | Polyamide | 2.8 | 7.9 | 50 | 5 | |
| Example 5 | Polymer E | 25 | none | 4.5 | 50 | 155 | 4.3 | 0.31 |
| Example 5A | Polymer E | 25 | Polyamide | 3.9 | 15.1 | 75 | 4.2 | |

The invention has been described in detail with particular reference to preferred embodiments thereof, but it will he understood that variations and modifications can be effected within the spirit and scope of the invention.

We claim:

1. A multiactive electrophotographic element comprising an electrically conductive support, a photoconductive pigment containing charge generation layer and a charge transport layer wherein the charge generation layer contains a polyester-ionomer binder having a weight average molecular weight of 2,500 to 75,000 and a glass transition temperature of 20° to 150° C.

2. A multiactive electrophotographic element comprising an electrically conductive support, a photoconductive pigment containing charge generation layer and a charge transport layer wherein the charge generation layer (A) is in direct physical contact with the conductive support and (B) contains a polyester-ionomer binder having a molecular weight of 2,500 to 75,000 and a glass transition temperature of 20° to 150° C.

3. A multiactive electrophotographic element comprising in the following order, a conductive support, a barrier layer, a photoconductive pigment containing charge generation layer and a charge transport layer wherein the charge generation layer contains a polyester-ionomer binder having a molecular weight of 2,500 to 75,000 and a glass transition temperature of 20° to 150° C.

4. A multiactive electrophotographic element according to claim 2 or 3 wherein the polyester-ionomer has a structure according to formula I:

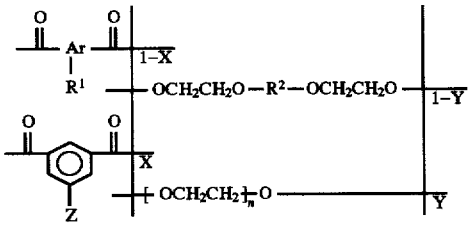

wherein $R^1$ represents alkyl groups such as methyl, and t-butyl;

$R^2$ represents cyclohexyl, 1,4-dimethylenecyclohexane, 4,4'-benzophenone, 4,4'-diphenylmethane, diphenylsulfone, 4,4'-isopropylidene bisphenylene, 4,4'-hexafluoroisopropylidene bisphenylene, 4,4'-cyclohexylidene bisphenylene, 4,4'-norbornylidene bispheylene, 4,4'-indnylidene bisphenylene, and 4,4'-fluorenylidene bisphenylene Ar represents an aromatic group that contains an asymetric center;

Z represents

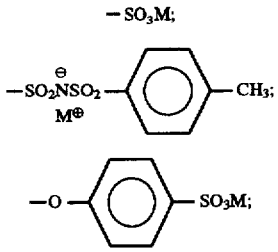

M represents an alkali earth metals such as lithium, sodium, or potassium; ammonium, trimethylammonium, triethylammonium, and hydroxylalkylammonium such as dihydroxyethylammonium, and trihydroxyethylammonium; and n is an integer of from 2 to 12;

X represents from 1 to 30 mole percent; and

Y represents from 0 to 100 mole percent.

5. A multiactive electrophotographic element according to claim 4 wherein the polyester-ionomer is selected from the group consisting of:

poly[1,4-cyclohexylenedimethylene-co-2,2'-oxydiethylene (46/54)isophthlate-co-5-sodiosulfoisophthlate (95/5)];

poly[1,4-cyclohexylenedimethylene-co-2,2'-oxydiethylene (46/54)isophthlate-co-5-sodiosulfoisophthlate (90/10)];

poly[1,4-cyclohexylenedimethylene-co-2,2'-oxydiethylene (46/54)isophthalate-co-5-sodiosulfoisophthalate (85/15)];

poly[1,4-cyclohexylenedimethylene-co-2,2'-oxydiethylene (46/54)isophthalate-co-5-sodiosulfoisophthalate (80/20)];

poly[1,4-cyclohexylenedimethylene-co-2,2'-oxydiethylene (46/54)isophthalate-co-5-sodiosulfoisophthalate (75/25)];

poly[1,4-cyclohexylenedimethylene-co-2,2'-oxydiethylene (46/54)isophthalate-co-5-lithiosulfoisophthalate (90/10)];

poly[1,4-cyclohexylenedimethylene-co-2,2'-oxydiethylene (46/54)isophthalate-co-triphenylmethylphosphoniumsulfoisophthalate (90/10)];

poly{1,4-cyclohexylenedimethylene-co-2,2'-oxydiethylene (46/54)isophthalate-co-5-(4-sulfophenoxy)isophthlate (90/10)};

poly{1,4-cyclohexyloxydiethylene terephthalate-co-5-(4-sulfophenoxy)isophthalate (70/30)}; and poly[1,4-cyclohexylenedimethylene-co-2,2'-oxydiethylene (46/54)isophthalate-co-4,4'-dicarboxyphenylmethylphenyl phosphonium p-toluenesulfonate (90/10)].

6. A multiactive electrophotographic element according to claim 4 wherein the polyester-ionomer has a weight average molecular weight of 10,000 to 45,000 and a glass transition temperature of 25° to 85 ° C.

7. A multiactive electrophotographic element according to claim 6 wherein concentration of the polyester-ionomer in the charge generation layer is 10 to 90 weight percent and the concentration of the photoconductive pigment is 30 to 70 weight percent.

8. A multiactive electrophotographic element according to claim 4 wherein the photoconductive pigment is selected from the group consisting of phthalocyanines, titanlyphthalocyanines, titanylfluorophthalocyanines, hydroxygalliumphthalocyanines, co-crystals of titanylphthalocyanine and titanylfluorophthalocyanine, non-uniformly substituted phthalocyanine, chloroindiumphthalocyanines, bromoindiumphthalocyanines and naphthophthalocyanines.

9. A multiactive electrophotographic element according to claim 5 wherein the photoconductive pigment is a co-crystal of 75 weight percent titanylphthalocyanine and 25 weight percent titanylfluorophthalocyanine, and the polyester-ionomer poly[1,4-cyclohexylenedimethylene-co-2,2'-oxydiethylene (46/54) isophthlate-co-5-sodiosulfoisophthlate (95/5)].

10. A multiactive electrophotographic element according to claim 5 wherein the photoconductive pigment is a co-crystal of 75 weight percent titanylphthalocyanine and 25 weight percent titanylfluorophthalocyanine.

* * * * *